United States Patent [19]

Ueda et al.

[11] 4,167,427

[45] Sep. 11, 1979

[54] HEAT TREATMENT OF TITANIUM ALLOYS

[75] Inventors: Shoji Ueda; Takashi Daikoku, both of Nagasaki; Yorimasa Takeda, Isahaya; Akira Hiromoto, Nagasaki; Nobuyuki Nagai, Kobe; Yasuo Moriguchi, Nishinomiya; Yoshimasa Ito, Kobe, all of Japan

[73] Assignees: Mitsubishi Jukogyo Kabushiki Kaisha, Tokyo; Kobe Steel, Ltd., Kobe, both of Japan

[21] Appl. No.: 843,251

[22] Filed: Oct. 18, 1977

[30] Foreign Application Priority Data

May 25, 1977 [JP] Japan ..... 52-60792

[51] Int. Cl.[2] ..... C22F 1/18

[52] U.S. Cl. ..... 148/133; 148/158

[58] Field of Search ..... 75/175.5; 148/133, 158

[56] References Cited

U.S. PATENT DOCUMENTS

| | | | |
|---|---|---|---|
| 2,691,578 | 10/1954 | Herres et al. | 75/175.5 |
| 2,718,465 | 9/1955 | Herres et al. | 148/133 |
| 2,754,204 | 7/1956 | Jaffee et al. | 148/133 X |
| 2,801,167 | 7/1957 | Crossley et al. | 75/175.5 |
| 2,821,475 | 1/1958 | Jaffee et al. | 75/175.5 |
| 2,906,654 | 9/1959 | Abkowitz | 75/175.5 |
| 3,405,016 | 10/1968 | Jaffee et al. | 148/133 |
| 3,802,939 | 4/1974 | Ohtani et al. | 148/133 X |

*Primary Examiner*—L Dewayne Rutledge
*Assistant Examiner*—Peter K. Skiff
*Attorney, Agent, or Firm*—Holman & Stern

[57] ABSTRACT

In a process for heat treating titanium alloys, and $\alpha+\beta$ titanium alloy, heated and held in a temperature range above 500° C. and below the $\alpha+\beta/\beta$ transformation point, and then quenched, is further aged at a low temperature in the range between 50° and 300° C.

2 Claims, 3 Drawing Figures

HEAT TREATMENT OF TITANIUM ALLOYS

This invention relates to improvements in heat treatment of titanium alloys.

In manufacturing the rotating blades of steam turbines and the like, particularly of large sizes or for high speed operations, it is very desirable to use a material of great specific strength and high internal friction, because such a material reduces the loads on the rotors and prevents fatigue failure of the blades. The present invention is specifically concerned with improvements in heat treatment of $\alpha+\beta$ titanium alloys which will satisfy these conditions.

Moving blades of steam turbines and the like must be protected against fatigue failure due to vibrations during operation. Theoretically, in order to reduce the vibratory forces, it is only necessary to eliminate the resonances of the blades. However, designing blades free of resonance in all modes of vibration is practically impossible. A compromise is, therefore, to either design a blade difficult to resonate or damp the vibrations that will accompany the resonance. The latter is accomplished in a number of ways. One of the methods is to convert the vibration energy into thermal energy and dissipate it within the material, that is, to damp the vibrations by means of the internal friction. This has been found very useful in minimizing the vibration-producing forces. The method is generally known as "material damping." Metals highly capable of material damping are advantageously used in building machinery and fabricating machine parts which tend to cause vibrations in operation that can lead to fatigue failure. In fact, such metals including 13% Cr stainless steel, such as AISI type 403, and high Co-base alloy being marketed under the trade designation "Nivco-10," are in use. A drawback common to these materials is the low yield strength as measured with the permanent strain of 0.2%, which is at most 80 kg/mm$^2$. The 13% Cr stainless steel can be given added strength without appreciable sacrifice of its ductility and thoughness by subjection to a suitable heat treatment or by an appropriate control of its composition. The increase in strength, on the other hand, sharply reduces the material damping capacity as exemplified by material C (in the broken line connecting "x" marks) in FIG. 3. The original high damping effect can no longer be expected. In the graph the material damping characteristics of the specimens, determined using tuning-fork-shaped test pieces, are represented in terms of logarithmic decrements as against specific strengths.

Figure 3:
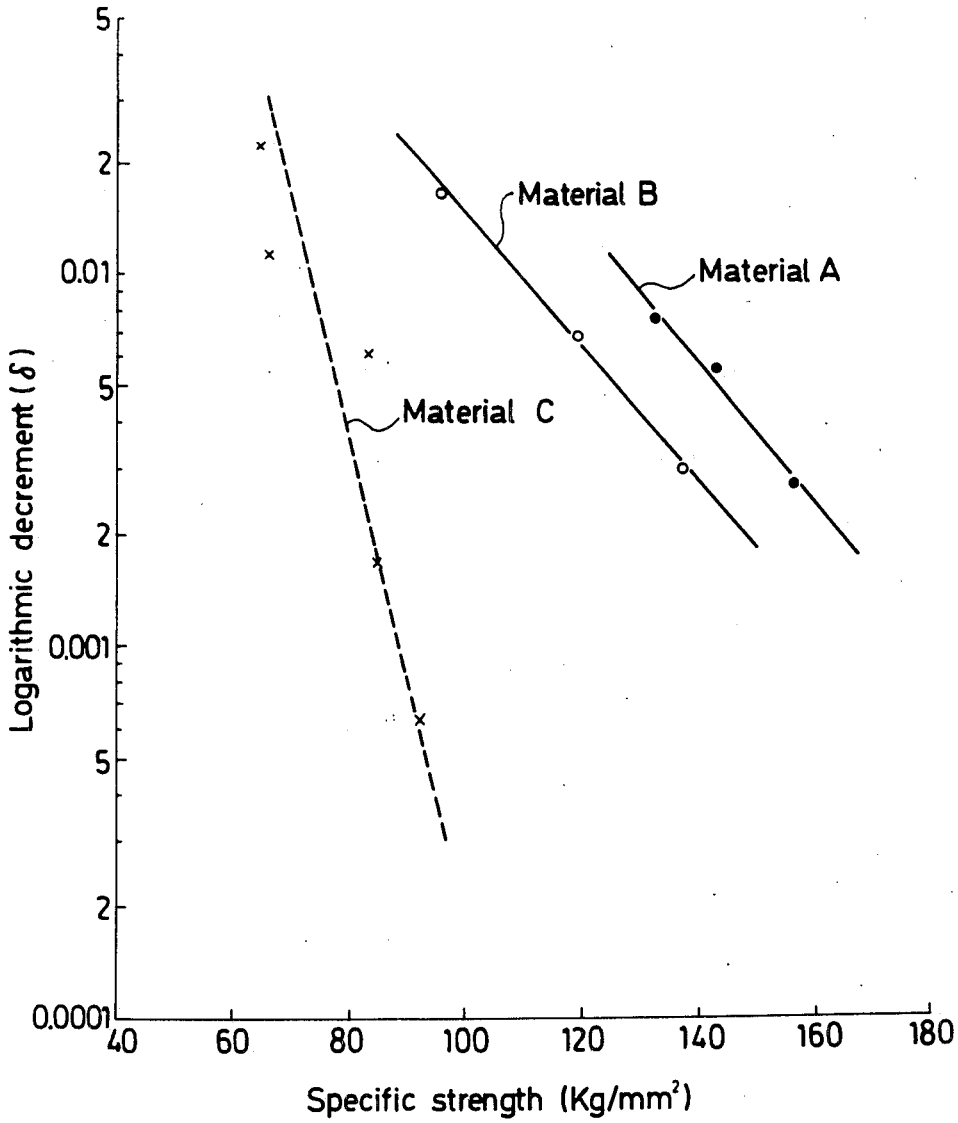

FIG. 3 illustrates the relations between the 0.2% yield strengths of various materials (given as specific strengths on the abscissa) and the logarithmic decrements ($\delta$) where the vibration stress is 10 kg/mm$^2$. The decrements of the AISI type 403 steel is based on numerical values quoted from the literature (W. C. Hagel and J. W. Clark: Journal of Applied Physics, Sept. 1957, pp. 426–430). Since the original data are given as decrements versus yield strengths as measured with the permanent strain of 0.02% rather than 0.2%, the yield strength values for the present graph were recalculated, for convenience of comparison, by adding 7 kg/mm$^2$ ($10^4$ psi) to each value of 0.02% yield strength appearing in that literature.

Now that there is a growing tendency toward larger and faster steam turbines, materials with better mechanical properties and material damping characteristics than the existing ones are required for the fabrication of their blades, especially for low-pressure stage applications.

Commercially available titanium alloys subjected to annealing or solution-aging treatment exhibit great specific strengths, and, because of their beneficial effects, such as reduction of loads on the rotors, they are believed to be highly promising materials for the blades of larger and faster steam turbines of tomorrow. For the purposes of the invention the term "solution-aging treatment" is used to mean a series of heat treatments usually performed, for example, with the Ti-6Al-4V alloy, by heating the metal at 925° C. for one hour, water quenching, and reheating at 500° C. for four hours, and finally aging the heat treated material. However, the Ti-6Al-4V alloy, now in the widest use as a practical titanium alloy, would show only a limited material damping effect when heat treated in this way, proving to be decidedly inferior in this respect to AISI type 403 steel.

In view of this, we previously invented a process for increasing the material damping capacity of the existing $\alpha+\beta$ titanium alloys by heating and holding such an alloy in the $\alpha+\beta$ phase region and in a temperature range over 500° C. and then quenching the same. A patent application for the process was filed as Japanese Patent Application No. 3072/74. It was then found that the existing $\alpha+\beta$ titanium alloys including, for example, the Ti-6Al-4V alloy, lose much of their improved material damping capacities and become somewhat unstable thermally upon heating and holding at 100° C. or upwards following the hardening. To correct these shortcomings, we invented $\alpha+\beta$ titanium alloys of the Ti-Al-V-Mo system superior in the thermal stability of material damping capacity and with greater absolute values of material damping than prior art alloys, and also invented a process of heat treatment for producing such superior alloys, that is, a process for quenching the starting alloys from a temperature range lower than the $\alpha+\beta/\beta$ transformation point by 125° C. The novel alloys and the processes are covered by our copending Japanese Patent Application No. 49056/76.

Our two previous inventions briefly outlined above have a common drawback of decreased 0.2% yield strength despite the increased material damping capacity, that is, a reduction in the specific strength, a most important advantage generally claimed for titanium alloys.

The present invention has for its object to improve our previously proposed processes for heat treatment and provide a process for heat treating titanium alloys so as to obtain alloys with increased material damping capacity and enhanced specific strengths.

Thus, the invention resides in a process for heat treating $\alpha+\beta$ titanium alloys characterized in that an $\alpha+\beta$ titanium alloy, heated and held in a temperature range above 500° C. and below the $\alpha+\beta/\beta$ transformation point, and then quenched, is further aged at a low temperature in the range between 50° and 300° C.

Figure 1:
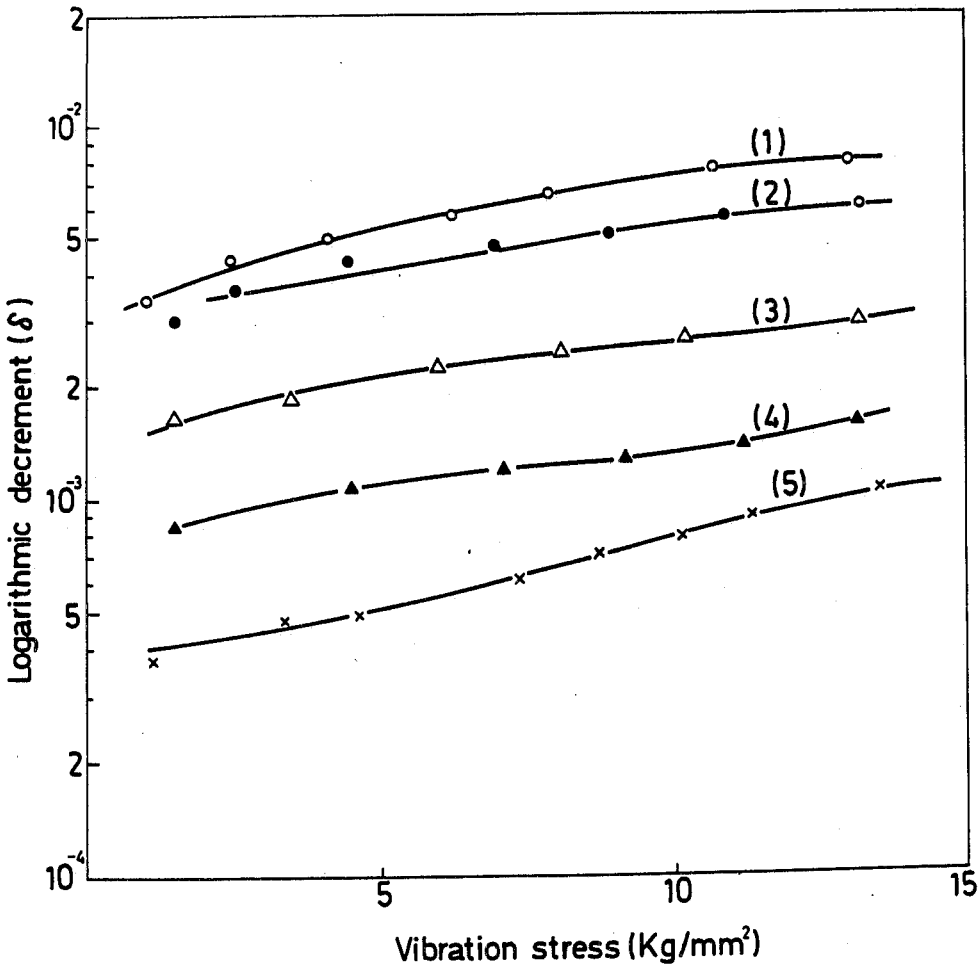
Figure 2:
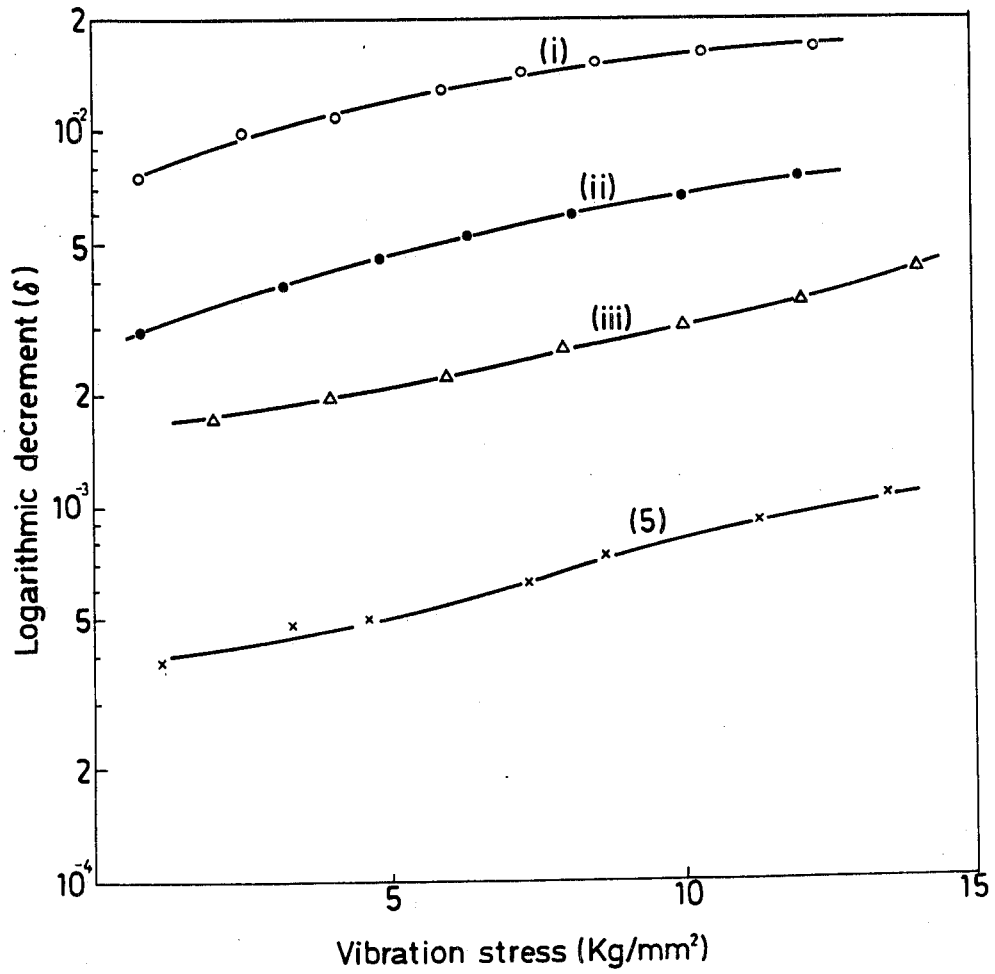

Other objects and advantages of the invention will become more apparent from the following description taken in conjunction with the accompanying drawings, in which:

FIGS. 1 and 2 are graphs showing the relations between vibration stresses and logarithmic decrements ($\delta$) of $\alpha+\beta$ titanium alloys heat treated in accordance with the process of the invention and other processes; and FIG. 3 is a graph showing the relations between the specific strengths and logarithmic decrements ($\delta$) of $\alpha+\beta$ titanium alloys heat treated by the present process and of a reference material.

The mechanism of material damping by the $\alpha+\beta$ titanium alloys heat treated in accordance with this invention may be explained as follows.

It has already been noted that an $\alpha+\beta$ titanium alloy acquires an increased material damping capacity upon quenching from a certain temperature range, for example, in the $\alpha+\beta$ phase range and not lower than 500° C. This beneficial effect results from the fact that the quenching enables a metastable $\beta$ phase to remain in the alloy even at room temperatures. In achieving the effect, the isomorphous $\beta$-stabilizers present in the $\alpha+\beta$ titanium alloy play an important role. However, the thermal stability of this metastable $\beta$ phase is such that decomposition is believed to take its course in accordance with a TTT (Time-Temperature-Transformation) diagram having a nose at a relatively low temperature of 300° C., and during this period the alloy may sometimes be embrittled by precipitation of the $\delta$ phase. The low-temperature aging decomposes the metastable $\beta$ phase to which the material damping of the $\alpha+\beta$ titanium alloy is largely attributable, and changes a part of the metal structure to the more stable $\alpha+\beta$ phase. As a result, the alloy gradually recovers its 0.2% yield strength, although its material damping capacity is sacrified to some extent. During the course of aging, precipitation of the $\omega$ phase, a transition phase, can take place. Should this happen, the 0.2% yield strength would be remarkably improved but the alloy would be embrittled with sharp decreases in ultimate elongation and drawability.

For the purposes of the invention, the expression "specific strength" as used herein means the following:

The 0.2% yield strength being the same, materials of different specific gravities, when fabricated in rotating blades, for example, would have different allowable maximum radii and allowable maximum angular velocities. Thus, if it is assumed that all materials have the same specific gravity as a typical rotating blade material of the steel type in wide use (the latter being herein represented by the stainless steel of AISI No. 403, or type 403 steel), then their 0.2% yield strengths recalculated accordingly (hereinafter referred to as "specific strengths" for brevity) can be simply compared with the specific strength of AISI type 403 steel (which may, of course, be equal to the basic 0.2% yield strength) to evaluate the adaptability of the individual materials for the blade applications from the viewpoint of their mechanical properties.

Now, let the 0.2% yield strength and specific gravity of a given material be $\sigma Y$ and $\rho$, respectively, and assume that a rotating body is made of this material. Then, the centrifugal force $\sigma$ of the rotating body is given by the equation $$\sigma = f \cdot \rho \cdot \Delta \cdot \omega^2 \quad (1)$$

where $f$ = form factor $\gamma$ = radius of rotation $\omega$ = angular velocity Considering the relation between the strength and centrifugal force of this material from Eq. (1), the allowable maximum angular velocity $\omega_{max}$ of this material will be $\omega_{max}2 = (2/f\gamma)\cdot(\sigma Y/\rho)$. Then, supposing we have rotating bodies of the same contour, the square of allowable maximum angular velocity will be proportional to the $\sigma Y/\rho$ of this material. The larger this value, the faster the rotating body will be allowed to run. Also, the angular velocity being equal, the limit of radius $\gamma_{max}$ of the rotating body will be obtained by Eq. (1) to be $\gamma_{max} = (1/f\ \omega^2)\cdot(\sigma Y/\rho)$. The larger this value, the longer the radius of the rotating body will be, because the $\gamma_{max}$ is proportional to the $\sigma Y/\rho$. In short, the $\sigma Y/\rho$ serves as a criterion upon which to evaluate the quality or adaptability of a material for fabrication into a rotating body. Eq. (1) may then be changed into $$\sigma Y \cdot (\rho Fe/\rho) = f \cdot \rho Fe \cdot \rho \cdot \omega^2 \quad (2)$$

where $\rho_{Fe}$ is the specific gravity of AISI type 403 steel. The right side of Eq. (2) signifies the centrifugal force of any of rotating bodies made of a material having the same specific gravity as type 403 steel to the same configurations and the same angular velocity. The left side signifies the maximum stress allowed for the material when assumed to have the same specific gravity as type 403 steel, that is, the 0.2% yield strength of the material as converted into the value of the material assumed to be of the same specific gravity as type 403 steel. Then, in order to evaluate the 0.2% yield strength of a given material other than the generally accepted steels, such as type 403 steel, for steam turbine blade applications, it is convenient to express the strength as $\sigma Y \cdot (\rho Fe/\rho)$, that is, as recalculated on the assumption that the material has the same specific gravity as type 403 steel (the specific gravities of other steel materials for steam turbine blades being not materially different from that of type 403 steel). For simplicity, this value is herein referred to as "specific strength." It thus follows that a mere comparison of the specific strength of a given material with that of the 13% Cr steel in widest use today, for example, AISI type 403 steel (where $\rho = \rho_{Fe}$ and hence, of course, the specific strength is equal to the 0.2% yield strength), will readily permit one to judge the adaptability of the particular material for the rotor application from the standpoint of its mechanical properties.

The process of the invention will now be illustrated in detail by the following examples.

One hundred kilograms each of $\alpha+\beta$ titanium alloys, of two different chemical compositions as represented by symbols A and B in Table 1, were separately melted by consumable-electrode vacuum arc melting. The heats were then ingotted to a cross section of 55 mm by 55 mm each by $\beta$ forging, and thence to a section of 20 mm by 30 mm each by $\alpha+\beta$ forging. The test pieces thus obtained were used in the tests to be described later. Also, a typical chemical composition of AISI type 403 steel, as representative of the 13% Cr steel in extensive use for steam turbine blade applications in given, with symbol C, in Table 1.

Table 1

| Symbol | Material | Al | V | Mo | Fe | C | O | N | H | Ti |
|---|---|---|---|---|---|---|---|---|---|---|
| A | Ti-6Al-4V | 6.35 | 4.20 | — | 0.204 | 0.014 | 0.189 | 0.0027 | 0.0021 | bal. |
| B | Ti-6Al-4V-3Mo | 6.09 | 4.25 | 3.13 | 0.260 | 0.018 | 0.103 | 0.0050 | 0.0058 | bal. |

Table 1-continued

| Symbol | Material | C | Si | Mn | Ni | Cr | Fe |
|---|---|---|---|---|---|---|---|
| C | AISI No. 403 | 0.12 | 0.26 | 0.54 | 0.38 | 12.05 | bal. |

Note: All values are in percent by weight.

Now the favorable effects of our previous inventions upon the material damping characteristics of titanium alloys as disclosed in Japanese Patent Application Nos. 3072/74 and 49056/76 will be briefly discussed. Those effects are summarized, together with other results to be described later, and graphically represented in FIGS. 1 and 2 and also, in a modified form as already noted, in FIG. 3.

FIG. 1 is a graph showing the relations between the logarithmic decrements $\delta$ and vibration stresses of specimens of material A subjected to different heat treatments. The conditions of heat treatments for the specimens represented by the curves were as follows. The specimen of curve (1) (connecting white dots) was heated at 800° C. for one hour and then water quenched (that is, hardened); the specimen of curve (2) (connecting black dots) was heated at 800° C. for one hour, water quenched, heated at 100° C. for two hours, and then air cooled (that is, hardened and aged at low temperature); the specimen of curve (3) (connecting white triangles) was heated at 800° C. for one hour, water quenched, heated at 200° C. for two hours, and then air cooled (that is, in the same state as (2) above); the specimen of curve (4) (connecting black triangles) was heated at 800° C. for one hour, water quenched, heated at 300° C. for two hours, and then air cooled (ditto); and the specimen of curve (5) (connecting "x" marks) was in the annealed state. FIG. 2 also graphically illustrates the relations between the logarithmic decrements $\delta$ and vibration stresses of the annealed material A (represented by curve (5) connecting "x" marks) and of variously heat-treated specimens of material B in Table 1 (represented by curves (i) to (iii)). Here the heat treatment conditions were: for curve (i) (connecting white dots), heating at 850° C. for one hour and water quenching (that is, to a hardened state); for curve (ii) (connecting black dots), heating at 850° C. for one hour, water quenching, heating at 200° C. for one hour, and then air cooling (that is, to a hardened and then low-temperature-aged state); and for curve (iii) (connecting white triangles), heating at 850° C. for one hour, water quenching, heating at 250° C. for one hour, and then air cooling (ditto).

It will be understood from FIG. 1 that material A, when water quenched from 800° C. as represented by curve (1), is much improved in the material damping capacity as compared with the specimen in the annealed state.

As can also be seen from FIG. 2, material B upon water quenching from 850° C. as in curve (i) attains even better material damping characteristic than that of the specimen of material A water quenched from 800° C.

Table 2 summarizes the results of tests conducted, simultaneously with the tests on material damping characteristics, to determine the mechanical properties of the two $\alpha+\beta$ titanium alloys of Table 1, in the annealed state and in the "hardened" state. By the "hardened" state is meant the specimen heat treated for an improvement in the material damping characteristic as taught by either Japanese Patent Application No. 3072/74 or 49056/76, that is, in the state after having been heated at either 800° C. or 850° C. for one hour and then water quenched. As can be seen from Table 2, the mechanical properties of the test alloys in the hardened state are little deteriorated as compared with those of the specimens in the annealed state.

Table 2

| Symbol | Material | Conditions of heat treatment | 0.2% Yld str $\sigma Y$ kg/mm$^2$ | Tens str $\sigma T$ kg/mm$^2$ | Elong % | Reduc of area % | Spec grav $\rho$ g/cm$^3$ | Sp str $\frac{7.72\sigma Y}{\rho}$ kg/mm$^2$ |
|---|---|---|---|---|---|---|---|---|
| A | Ti-6Al-4V | Annealed | 98.0 | 105.0 | 13.0 | 26.0 | 4.45 | 170.0 |
| | | 800° C.×1H . WQ (hardened) | 76.9 | 100.6 | 17.2 | 31.6 | " | 133.4 |
| B | Ti-6Al-4V -3Mo | Annealed | 96.3 | 101.5 | 15.2 | 45.0 | 4.54 | 163.8 |
| | | 850° C.×1H . WQ (hardened) | 56.3 | 106.2 | 16.0 | 34.2 | " | 95.7 |

The only exception is the 0.2% yield strength, which strikingly decreased in both materials, by about 20 kg/mm$^2$ for material A and by about 40 kg/mm$^2$ for material B. This deterioration of the 0.2% yield strength upon hardening is reflected in the specific strength. Material A, which is in the widest use of all titanium alloys, exhibits a specific strength of 170 kg/mm$^2$ in the annealed state but as low as about 133 kg/mm$^2$ when hardened. Material B also shows a sharply decreased value of only about 96 kg/mm$^2$ upon hardening. Nevertheless, it will be appreciated that the both alloys still possess specific strengths of approximately 100 kg/mm$^2$ and that these two kinds of $\alpha+\beta$ titanium alloys in the hardened state are more than equal in specific strength to AISI type 403 steel.

Indeed, the processes disclosed in Japanese Patent Application Nos. 3072/74 and 49056/76 for improving the material damping characteristics of titanium alloys make the alloys well comparable or even superior in 0.2% yield strength, or specific strength, to the existing steam turbine blade material, AISI type 403 steel. On the other hand, as will be understood from the foregoing explanation, the processes cause deterioration in the specific strengths of the alloys from the levels in the annealed state.

With these in view, we subjected these two kinds of $\alpha+\beta$ titanium alloys to aging at low temperature after the hardening, and examined the effects upon the material damping characteristics and mechanical properties of the alloys. The results are given in FIGS. 1 and 2 and in Table 3. The changes in the two properties are summarized and graphically represented in FIG. 3.

Throughout these figures like symbols are used to denote like materials. Referring to Table 3, Table 3

| Symbol | Material | Low-temp aging condition | 0.2% Yld str Y kg/mm² | Tens str T kg/mm² | Elong % | Reduc of area % | Sp str 7.72 Y / kg/mm² |
|---|---|---|---|---|---|---|---|
| A | Ti-6Al-4V | 100° C.×2H . AC | 83.1 | 102.1 | 17.2 | 31.2 | 144.2 |
| | | 200° C.×2H . AC | 90.4 | 104.5 | 17.0 | 28.4 | 156.8 |
| | | 200° C.×1H . AC | 70.4 | 106.5 | 16.0 | 31.8 | 119.7 |
| B | Ti-6Al-4V | 250° C.×1H . AC | 81.1 | 109.8 | 13.5 | 24.5 | 137.9 |
| | -3Mo 300° C.×1H . AC | 105.8 | 125.3 | 4.8 | 8.7 | 179.9 | |

the 0.2% yield strength and specific strength of material A after aging at the low temperature of 100° C. are 83.1 and 144.2 kg/mm², respectively, and, after aging at 200° C., 90.4 and 156.8 kg/mm², respectively, indicating recoveries close to the levels in the annealed state. Likewise, as Tables 2 and 3 clearly indicate, the low-temperature aging at 200° C. and 250° C. enables material B to recover its 0.2% yield strength remarkably from the value in the hardened state. On the other hand, it will be readily understood from FIGS. 1 and 2 that, the aging time being the same, the material damping characteristics of both materials A and B will decrease as the aging temperature increases. Therefore, in the same manner as with AISI type 403 steel, the relations between the specific strengths and material damping capacities of materials A and B are also graphically represented in FIG. 3. As clearly shown in the figure, the straight lines representing the characteristics of materials A and B are definitely and far on the right of the line of AISI type 403 steel (material C). This indicates that the low-temperature-aged $\alpha+\beta$ titanium alloys have by far the greater material damping capacities than AISI type 403 steel if the specific strengths are on the same level, or have by far the greater specific strengths if the material damping capacities are equal. When evaluating the two kinds of titanium alloys in the both aspects of specific strength and material damping, it is obvious that the low-temperature aging is an effective treatment as described above. From the viewpoint of other mechanical properties, the conditions of low-temperature aging at 300° C. of material B will now be considered. After aging for 30 minutes the elongation and reduction in area were, respectively, 10.2% and 19.5%, although these values are not carried in Table 3, and after aging for one hour the respective values were 4.8% and 8.7% (Table 3). The same applied to material A. Thus, it is clear that 300° C. is the upper limit of temperature at which the 0.2% yield strengths of the $\alpha+\beta$ titanium alloys can be improved without adversely affecting the elongation and reduction in area of those metals and that aging over an extended period of more than one hour can cause embrittlement of the $\omega$ phase.

As will be obvious from the description given above, the low-temperature aging is an extremely effective way of improving the usually contradictory mechanical properties and material damping characteristics of the $\alpha+\beta$ titanium alloys as hardened. The upper limit of temperature for the low-temperature aging must be such that the excellent material damping characteristic is maintained without causing the phase embrittlement. The lower limit must be such that the temperature substantially aids in the recovery of 0.2% yield strength. Although the data are not included in Table 3, at the temperature of 50° C. both materials A and B showed recoveries of the 0.2% yield strength by about 5 to 6 kg/mm² in about 50 hours. Hence, the lower limit is fixed at 50° C., and the upper limit is fixed at 300° C. for the reasons already clarified.

As has been described in detail, the process of the invention is an excellent heat treatment which permits improvements in both of the otherwise mutually inconsistent mechanical properties and internal friction characteristics of $\alpha+\beta$ titanium alloys. The alloys thus obtained are suitable for applications where damping of vibrations is essential and still good mechanical properties are required, for example, for rotating blades of huge turbines and the like that demand particularly high strengths.

What is claimed is:

1. A process for heat treating titanium alloys which comprises heating and holding an $\alpha+\beta$ titanium alloy of the Ti—6Al-V-Mo system in a temperature range over 500° C. and below the $\alpha+\beta/\beta$ transformation point, quenching, and then aging the same at a temperature in the range between 50° C. and 300° C., inclusive.

2. A method of treating an $\alpha+\beta$ titanium alloy whereby it maintains both material damping and 0.2% yield strength at high values, comprising rapidly cooling an $\alpha+\beta$ titanium alloy of the Ti-6Al-V-Mo system at a temperature exceeding 500° C. and below the $\alpha+\beta/\beta$ transformation point, and then allowing it to remain at a temperature within the range of from 50° C. to 300° C., inclusive, for about from one to fifty hours.

* * * * *